US008257069B2

(12) United States Patent
Satanovskiy

(10) Patent No.: US 8,257,069 B2
(45) Date of Patent: Sep. 4, 2012

(54) LOW SPEED, HIGH TORQUE ROTARY ABUTMENT MOTOR

(75) Inventor: Yan Satanovskiy, Lyndhurst, OH (US)

(73) Assignee: Yan A. Satanovskiy, Lyndhurst, OH (US)

( * ) Notice: Subject to any disclaimer, the term of this patent is extended or adjusted under 35 U.S.C. 154(b) by 396 days.

(21) Appl. No.: 12/183,088

(22) Filed: Jul. 31, 2008

(65) Prior Publication Data

US 2010/0028188 A1 Feb. 4, 2010

(51) Int. Cl.
*F01C 19/00* (2006.01)
*F03C 2/00* (2006.01)

(52) U.S. Cl. ..... 418/104; 418/136; 418/147; 418/221; 418/248

(58) Field of Classification Search ..... 418/104, 418/136–139, 145–147, 191, 196, 221, 247–249
See application file for complete search history.

(56) References Cited

U.S. PATENT DOCUMENTS 1,006,093 A * 10/1911 Holt ..... 418/250
3,846,055 A * 11/1974 Brundage ..... 418/124
2005/0281698 A1* 12/2005 Satanovskiy ..... 418/248

* cited by examiner

*Primary Examiner* — Theresa Trieu

(57) ABSTRACT

An improved high torque rotary abutment motor is provided that is capable of producing ultra high pressures, while still remaining light weight and reliably efficient. The rotary abutment motor is provided with a body and rotor are sealed in the axial direction with two face spring seals compensating for tolerance and wearing gap. In such a configuration, increasing pressures create increasing force of sealing, thereby allowing operational pressures in excess of what is currently available today.

7 Claims, 5 Drawing Sheets

Fig.1 SECTION A—A

Fig.2 SECTION B—B

HALF CYCLE CHART

LOW SPEED, HIGH TORQUE ROTARY ABUTMENT MOTOR

BACKGROUND OF THE INVENTION

1. Field of the Invention

The present invention relates generally to hydraulic motors and, more particularly, to a low speed, high torque hydraulic motor.

2. Description of the Related Art

Hydraulic motors are actuators (like hydraulic cylinders) that simply convert hydraulic pressure into rotary movement. Even though the construction is similar, motors differ from pumps in that they are ""pushed"" into rotation by the already active fluid. A hydraulic motor converts hydraulic energy into rotating motion by being pushed by hydraulic fluid. A hydraulic motor is rated by displacement, torque, speed and pressure limits. Further, they are classified as HSLT (High speed/Low torque), LSHT (Low speed/High torque) or Limited Rotation (Torque Actuators). Typical hydraulic motors (actually called a rotary hydraulic actuator) use some form of surface area to receive hydraulic fluid, which cause a shaft to spin, which is connected to various equipment driven by that hydraulic motor. The surface that is ""pushed"" may be rectangular in nature, as in gear, vane and rotary abutment motors, or circular in nature as in rotary and axial piston motors.

Commercially, there are available only several practical designs for low speed, high torque applications. Eaton Corporation Hydraulic Division developed a derivative called the Geroler™, which consists of an inner and outer rotor. The inner rotor has N teeth, and the outer rotor has N+1 teeth. One rotor is located off-center and both rotors rotate. During part of the assembly's rotation cycle, the area between the inner and outer rotor increases, creating a vacuum. This vacuum creates suction, and hence, this part of the cycle is where the intake is located. Then, the area between the rotors decreases, causing compression. During this compression period, fluids can be pumped, or compressed (if they are gaseous fluids). The Eaton Geroler™ design essentially uses bearing rollers instead of lobes on the ring to increase the mechanical efficiency. Greater efficiency comes at the price of greater manufacturing complexity and extreme fit tolerances involving single digit micrometers. Gerotor pumps are generally designed using a trochoidal inner rotor and an outer rotor formed by a circle with intersecting circular arcs. Although this design works well and is simple to define it does create gaps between the inner and outer rotor when the tooth of the inner rotor rotates into the pocket of the outer rotor. This gap seals during rotation causing inefficiency, noise and wear due to the pump attempting to compress the trapped and incompressible fluid in the gap. A Gerotor can also function as a motor. High pressure gas enters the intake area and pushes against the inner and outer rotors, causing both to rotate as the area between the inner and outer rotor increases. During the compression period, the exhaust is pumped out.

However, due to sealing limitations such commercially available hydraulic motors generally maintain a continuous pressure of around 3000 psi, while tolerating only intermittent pressure spikes in excess of that. Nowherein is there available a high torque hydraulic motor that is capable of producing ultra high pressures at speeds ranging from low to high, while still remaining light weight an reliably efficient.

Consequently, a need has therefore been felt for an improved but less complex high pressure, high torque hydraulic motor.

SUMMARY OF THE INVENTION

It is therefore an object of the present invention to provide an improved rotary abutment motor.

It is a feature of the present invention to provide increased power density, and thereby greater efficiency, by providing an improved rotary abutment motor designed to hold pressure exceeding 10,000 PSI [700 BAR] while maintaining a low coefficient of friction −0.06-0.07, that will provide a long dependable service life, excellent leakage control.

Briefly described according to the present invention, a rotary abutment motor is provided with simplicity of design (just 15 parts), in which the body and rotor are sealed in the axial direction with two face spring seals compensating for tolerance and wearing gap.

An advantage of the present invention is that increasing pressures create increasing force of sealing, thereby allowing operational pressures in excess of what is currently available today.

Further advantages of the present invention resulting from being able to use ultra high pressures include its compact size, higher reliability due to fewer parts, bidirectional operation and scalable size and performance.

BRIEF DESCRIPTION OF THE DRAWINGS

The advantages and features of the present invention will become better understood with reference to the following more detailed description and claims taken in conjunction with the accompanying drawings, in which like elements are identified with like symbols, and which:

FIG. 1 is axial section A-A of a rotary abutment motor according to the preferred embodiment of the present invention;

FIG. 2 is a section B-B thru the joint of the housing;

DESCRIPTION OF THE PREFERRED EMBODIMENTS

Figures 1A, 2A, 2B:
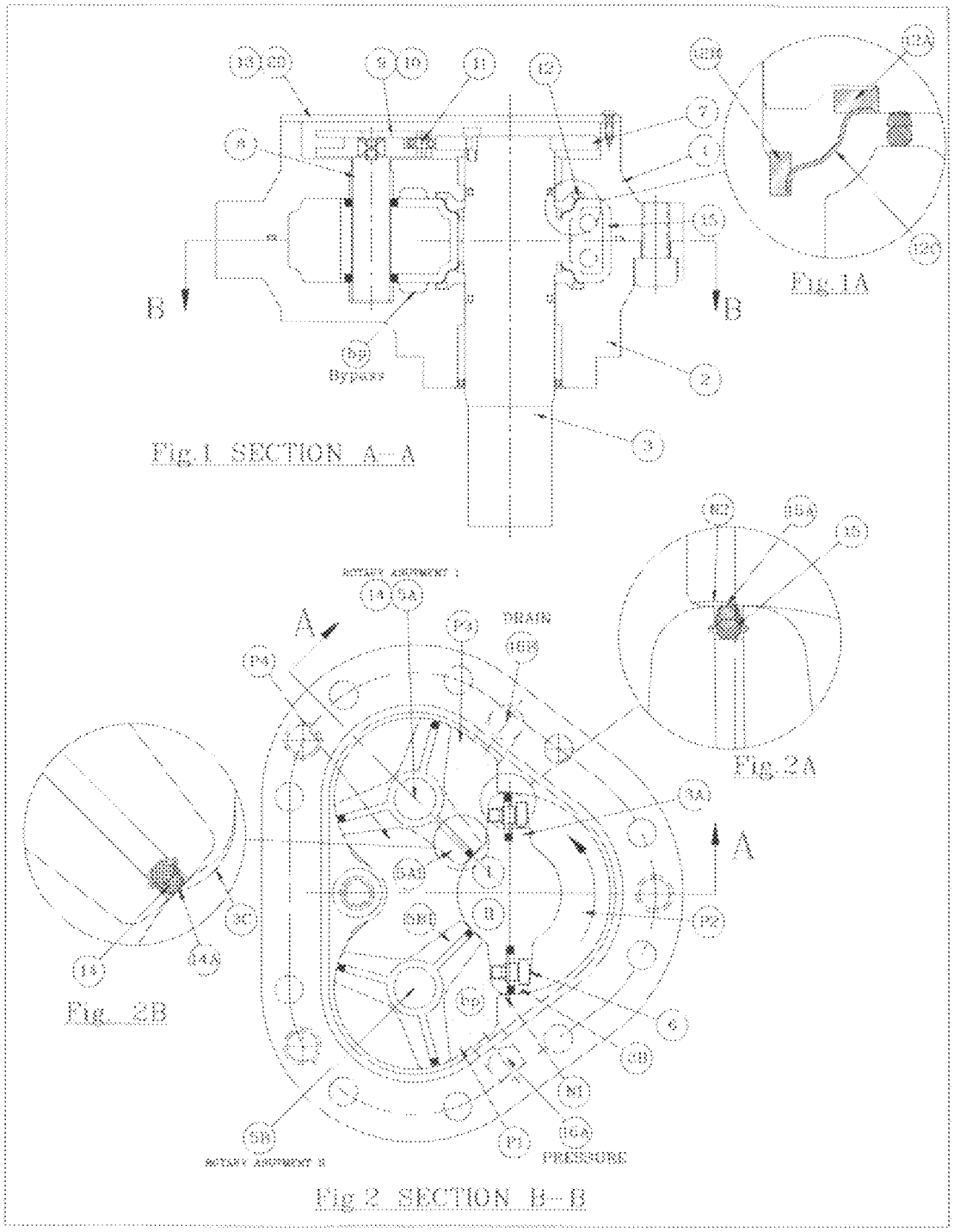
FIG. 1A is a partial detail cross sectional view of the face rotor seal that forms axial seal between shaft and housing.
FIG. 2A is a partial detail of rotor seal passing cutout in housing an equalizing pressure before vane of the rotor and behind.
FIG. 2B is a partial detail of star seal passing cutout in the rotor an equalizing pressure before vane of the star and behind.

The best mode for carrying out the invention is presented in terms of its preferred embodiment, herein depicted within the Figures.

1. Detailed Description of the Figures

Referring now to FIG. 1-4 a rotary abutment type hydraulic motor, generally noted as motor, shows the preferred embodiment of the invention having a housing formed of a housing top 1 and a hosing bottom 2 that serves to contain the fluid and moving parts of the motor. A drive rotor 3 with 2 symmetrical vanes 3A and 3B rotably mounted centrally within the housing supports. The drive rotor 3 provides an input/output mechanical interconnection for the power presenting the rotor structure 3A and 3B and a cylindrical member which rotates in respect to the housing of the motor. It is anticipated that each rotor vane has rectangular slot for rotor seal and having sealed rotor bolts 6 bolted there through such that each vane member is firmly mated together about rotor seal 15. This rotor seal 15 forms a seal between the rotor vane 3B and the interior surface of the housing that forms the fluid cavity P1 and is anticipated as having two separate elements: an inner rubber "O"-ring and outer trapezoidal plastic part. It has been found that the use of Zatkoff brand Turcon Glide Ring T seal can be utilized for pressure up to 11,600 psi [800 Bar]. Each seal there are reinforcement metal 14A for star seal and 15A for rotor seal to pass cutouts without squeezing-out and increase PV characteristic. Additionally, as shown in grater detail in conjunction with FIG. 1A, the housing and rotor are sealed in the axial direction with a rotor scal 12 that forms a face seal between surface of the rotor 3 such as to provide increased pressure sealing within the fluid cavity P1 and between stars. This is accomplished by having an upper ring 12A pressed into the body, and having a laterally movable lower ring 12B connected thereto by spring element 12C brazed to both rings. The high pressure inside the internal cavity P1 forces against the convexity of the seal. This urging force between ring 12B and the rotor 3 forces the sides of the seal outward, thereby increasing the sealing pressure and making the seal more effective at higher pressure.

In this manner, additional later force against the convexity 12C results from increasing pressure within the fluid cavity P1. In effect, the pressure within the fluid cavity P1 aids in generating a sealing force. This is opposite of most seal applications in which the sealing member must be strong enough to oppose direct pressure.

Additionally, the rotor vanes 3A, 3B and stars vanes 5A1, 5B1 (in next turn will be next vanes) form the main operative valve for the motor. This fluid cavity P1 is in fluid communication with a first port 16A, second port 16B for constant communication in respect thereto. Undercuts placed on both joint surfaces of the upper and lower bodies, and in the middle of the rotor vanes allow equalizing pressure smooth. The cavity P2 is interconnected by undercut N1 and N2 placed on the joint surface of the body to cavity P3. The operation of each of four undercuts 3C will be described in greater detail below.

A first rotary abutment I and second II are provided as operating symmetrically. For purposes of brevity, only the detailed description of the first rotary abutment I will be provided, it being understood that the second rotary abutment II is formed and operates similarly. The rotary abutment I is formed of a vane 3A and vane 5A1 of the star 5A. Each rotary abutment I and II rotates in an overlapping concentric fashion over the path of each rotor vane 3A, 3B respectively, such incremental progression of each star 5A, 5B in series can be implemented in timed fashion' synchronized to the position of the rotor 3 in order to alternately cause various chambers formed within the internal cavity P1, P2, P3, P4 to be pressurized or depressurized. As the rotor vane 3A passes through the rotation path of the abutment, the star rotates and unseal cavity P3 but vane 3B passed notch N1 and seal cavity P1 release pressure in front of vane 3B. In this manner, it is anticipated that each rotary abutment I, II can be bidirectional, and completely reversible under load. The absence of the springs and symmetry of the rotor and body can allow smooth, reverse operation. If torque applied to the rotor 3, and behind the vane 3B is suction in cavity P1 and before in cavity P2 is pressure—motor becomes a pump.

Figure 3:
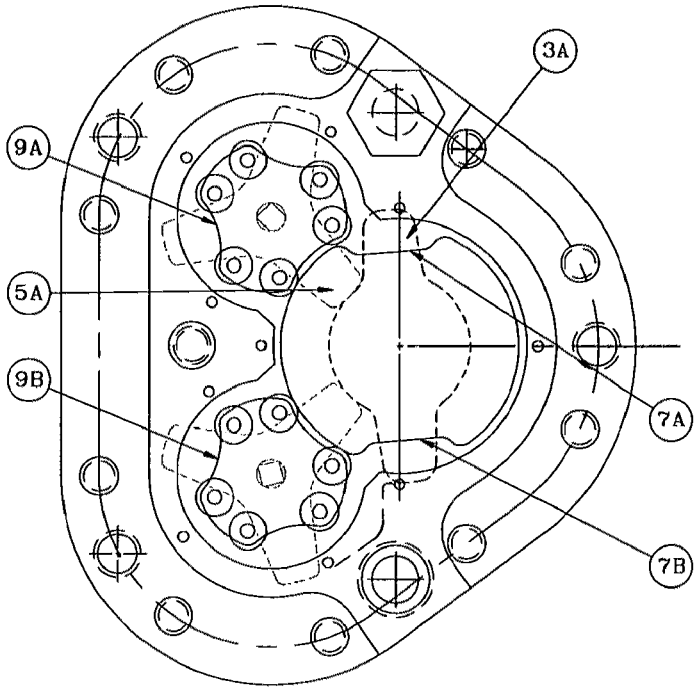
FIG. 3 is a top view showing a schematic representation of timing cams for operation of the rotary abutments and stars in the start of turning.
Figure 4:
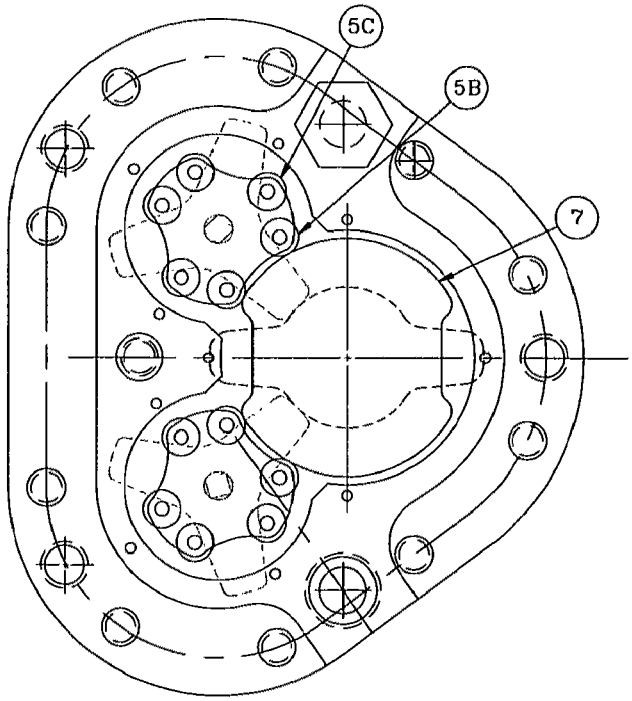
FIG. 4 is a top view showing a schematic representation of timing cams for operation of the rotary abutments and stars in the second (locked) position.
Figure 5:
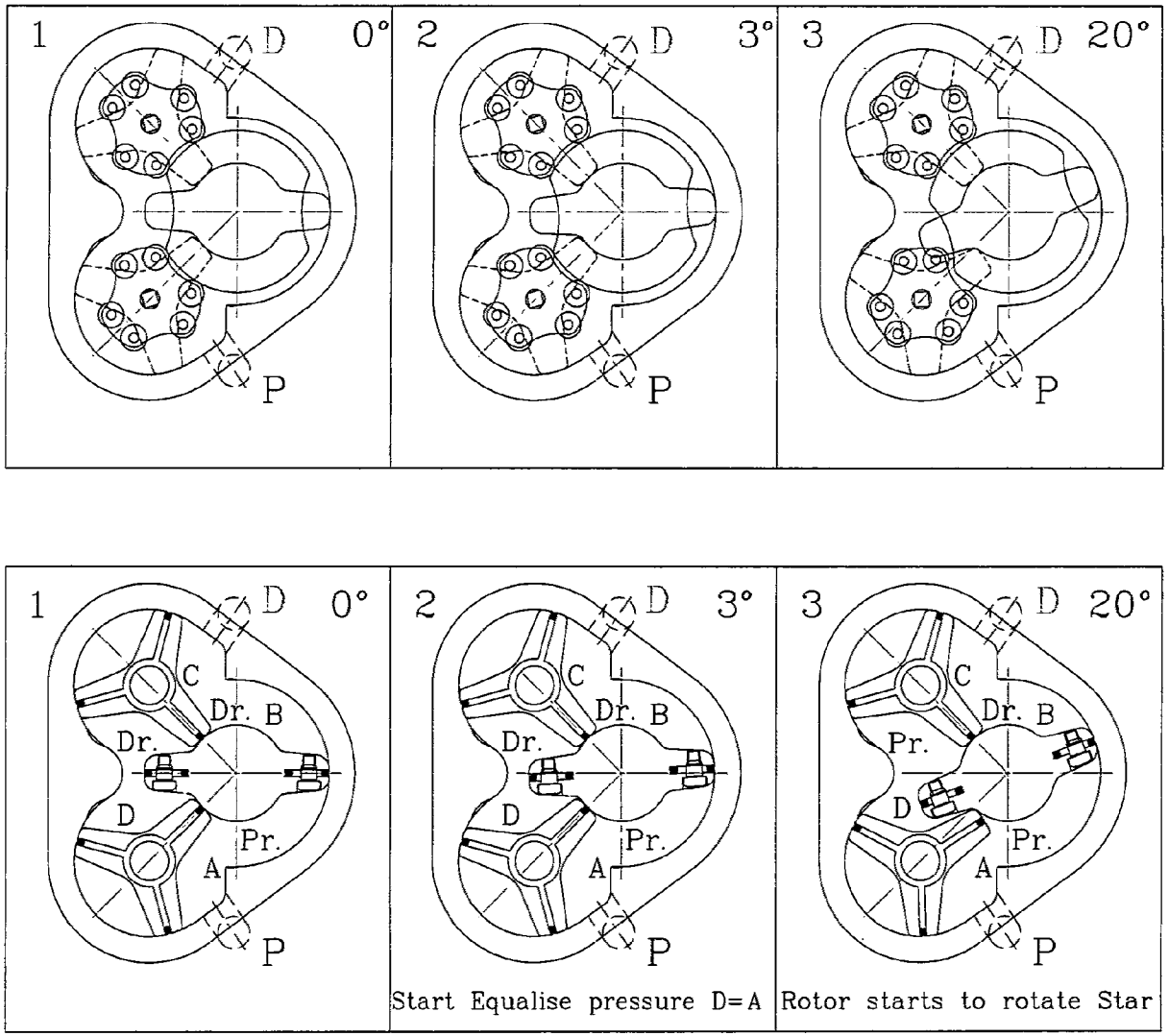
FIG. 5 is a half cycle chart positions 1, 2, 3.
Figure 6:
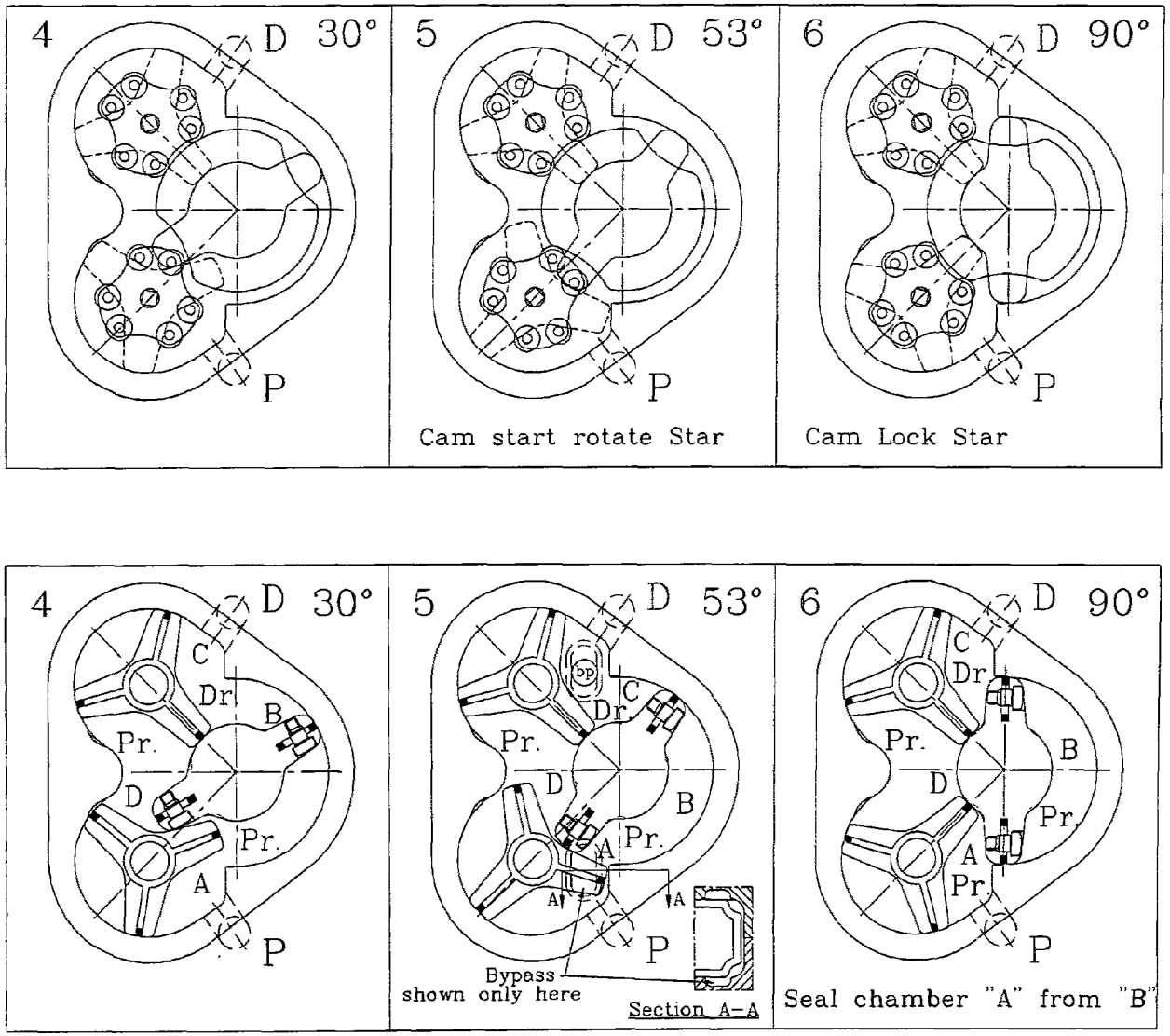
FIG. 6 is a half cycle chart positions 4, 5, 6.
Figure 7:
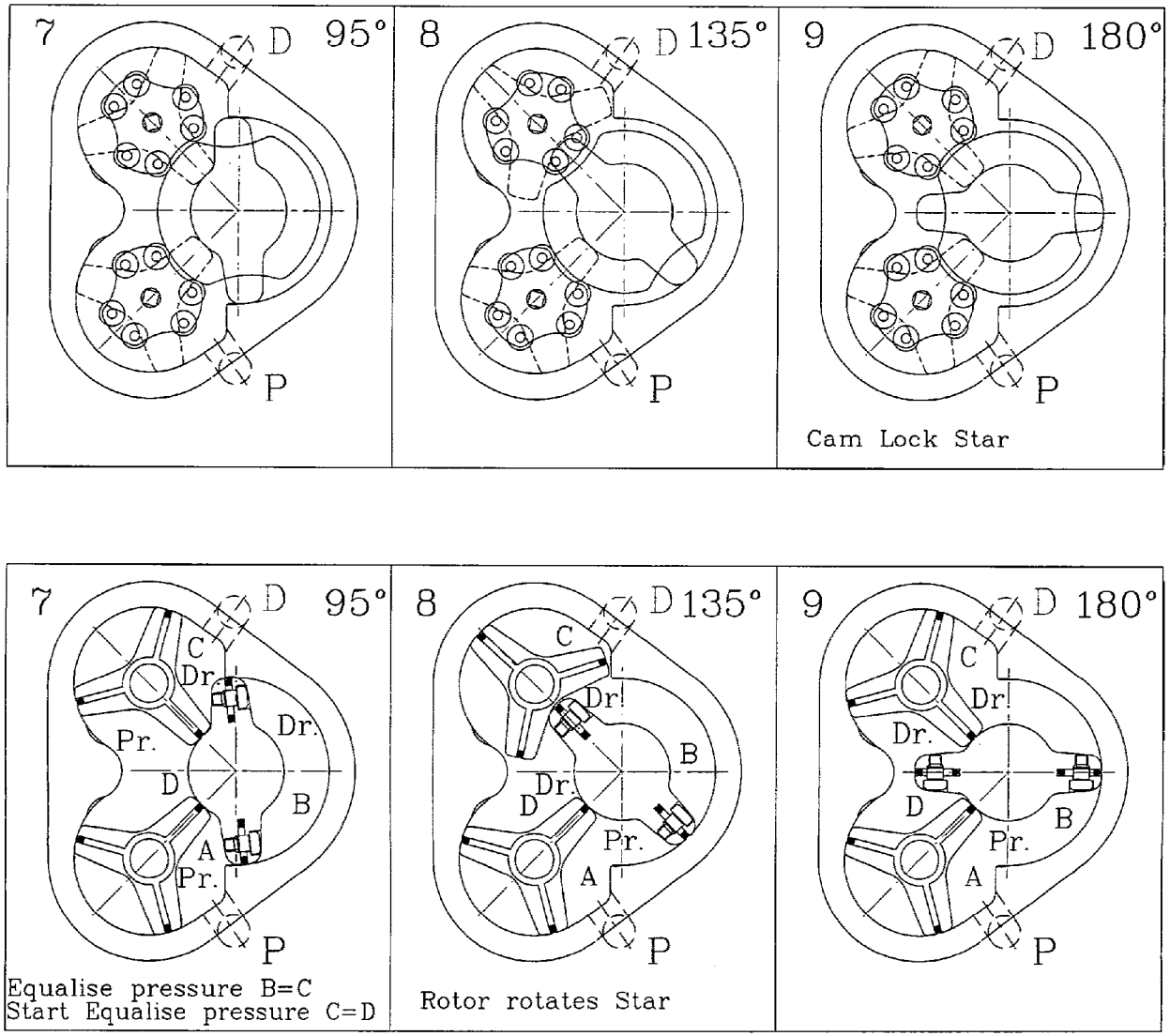
FIG. 7 is a half cycle chart positions 7, 8, 9.

Referring now to FIG.3 and 4, timing of the sequentially stepped and synchronized rotation of the stars 5A and 5B are accomplished though the use of inter-impinging cams. A rotor cam 7 is affixed to and rotates with the main rotor 3 and allows for both synchronization of the movements of each star 5A, 5B relative to the rotor 3, but also provides an urging force as well. A star cam 9B affixed to star 5B and rotating with the rotary abutment II impinges against the rotor cam 7 preventing rotation until concave timing inset approaches the star cam. A star 9A start rotates because of pressure vane 9A, at the same time concave 7A is passing through cam 9A and allow to rotate. When the star vane contact surface to vane of the rotor 3A is become tangent the star cam 9A is forced by corner of the concave 7A (FIG. 4) into the next sequential position and again locked in place through impingement. Similarly, the second star cam 9B functions in the same manner for synchronizing and rotating the second abutment II, and a second timing concave 7B opposite the first timing concave 7A functions to allow this sequential procedure continues for each rotary abutment I, II.

2. Operation of the Preferred Embodiment

In operation, the two ports 16A, 16B interconnected the motor to a source of high pressure and fluid return, with the direction of rotation of the motor dependent upon which port is pressurized. (motor can also be utilized as a pump by connecting the shaft 3 to a source of power in known manner). By way of example, and not as a limitation, and in connection with FIGURES, as pressurized fluid enters the second port 16B it pressurized the cavity P3 between the rotor vane 3A and vanes of star 5B of rotary abutment I and rotation is in a clockwise direction and discharge fluid in port 16A.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A rotary abutment type hydraulic motor comprising:

a housing formed of a housing top and housing bottom that serves to contain the fluid and moving parts of the motor;

an annular fluid passage formed within said housing, said fluid passage located surrounding the outer circumference of a drive rotor;

a first port and a second port formed by said housing and in fluid communications with said annular fluid passage;

a rotor rotatably mounted within said fluid passage and having a pair of aligned rotor vanes, a first rotor vane radially extended outward from said rotor and symmetric to a second rotor vane;

a face seal between said rotor and said housing, said face seal adapted such that high pressure inside the fluid passage creates an urging force between the rotor and the housing to force the face seal against the rotor, thereby increasing the sealing pressure against the joint face seal and the rotor; and at least one rotary abutment star that rotates in an overlapping concentric fashion over the path of each rotor vane and rotatably timed synchronizedly with said rotor such that between said rotor vane and said rotary abutment star, said rotor rotates in a pressure sealed manner, wherein said rotary abutment star comprises three symmetrical vanes, said rotary abutment star rotatably mounted to the housing and seal fluid cavities to separate high pressure from low pressure; wherein said first rotor vane and said second rotor vane form the main operative valve for said motor.

2. The hydraulic motor of claim 1, further comprising a second rotary abutment star, wherein said second rotary abutment star is identical to said at least one rotary abutment star and mounted symmetrically opposite thereto on said housing allows said hydraulic motor to function in a reverse fashion.

3. The rotary abutment type hydraulic motor of claim 1, wherein when said rotor comprises two vanes, abutment valves said stars with three vanes symmetrically placed and allow passing for rotor vanes;

whereby when said rotor vane starts to rotate said star when passing by, said rotor and housing always sealed at least with one said star thus separate cavities of high and low pressure.

4. A rotary abutment type hydraulic motor comprising:

a housing formed of a housing top and housing bottom that serves to contain the fluid and moving parts of the motor;

an annular fluid passage formed within said housing, said fluid passage located surrounding the outer circumference of a drive rotor;

a first port and a second port formed by said housing and in fluid communications with said annular fluid passage;

a rotor rotatably mounted within said fluid passage and having a pair of aligned rotor vanes, a first rotor vane radially extended outward from said rotor and symmetric to a second rotor vane, wherein said rotor vane is formed of a pair of vane members mated together firmly about the housing, cylindrical part of rotor mated together firmly about a star seal, wherein said star seal cavity a seal between said rotor and the interior surface of the housing that form fluid passage;

a face seal between said rotor and said housing, said face seal adapted such that high pressure inside the fluid passage creates an urging force between the rotor and the housing to force the seal against the rotor, thereby increasing the sealing pressure against the face seal and the rotor; and at least one rotary abutment star that rotates in an overlapping concentric fashion over the path of each rotor vane and rotatably timed synchronizedly with said rotor such that between said rotor vane and said rotary abutment star, said rotor rotates in a pressure sealed manner, wherein said first rotor vane and said second rotor vane form the main operative valve for said motor.

5. A rotary abutment type hydraulic motor comprising:

a housing formed of a housing top and housing bottom that serves to contain the fluid and moving parts of the motor;

an annular fluid passage formed within said housing, said fluid passage located surrounding the outer circumference of a drive rotor;

a first port and a second port formed by said housing and in fluid communications with said annular fluid passage;

a rotor rotatably mounted within said fluid passage and having a pair of aligned rotor vanes, a first rotor vane radially extended outward from said rotor and symmetric to a second rotor vane;

a face seal between said rotor and said housing said face seal adapted such that high pressure inside the fluid passage creates an urging force between the rotor and the housing to force the seal against the rotor, thereby increasing the sealing against the face seal and the rotor;

at least one rotary abutment star that rotates in an overlapping concentric fashion over the path of each rotor vane and rotatably timed synchronizedly with said rotor such that between said rotor vane and said rotary abutment star, said rotor rotates in a pressure sealed manner; and a synchronizing mechanism consisting of main cam mounted on said rotor and two side cams mounted on said stars, wherein said side cams locked on main cam and unlocked when rotor vane passing star and main cam finish rotating side cam to locked position;

wherein said first rotor vane and said second rotor vane form the main operative valve for said motor.

6. The rotary abutment type hydraulic motor of claim 5, wherein said face seal seals in an axial direction of said housing and said rotor, thereby compensating tolerance and wearing, and whereby pressure balancing, thereby keeping a contact load closer to the minimum for effective sealing and enabling said seal to withstand larger pressure reversals.

7. The rotary abutment type hydraulic motor of claim 6, wherein said face seal formed part of housing for rotor vanes.

* * * * *